US006623569B2

(12) United States Patent
Bergstrom et al.

(10) Patent No.: US 6,623,569 B2
(45) Date of Patent: Sep. 23, 2003

(54) DUPLEX STAINLESS STEELS

(75) Inventors: David S. Bergstrom, Natrona Heights, PA (US); John J. Dunn, Sarver, PA (US); John F. Grubb, Lower Burell, PA (US); William A. Pratt, Butler, PA (US)

(73) Assignee: ATI Properties, Inc., Albany, OR (US)

( * ) Notice: Subject to any disclaimer, the term of this patent is extended or adjusted under 35 U.S.C. 154(b) by 0 days.

(21) Appl. No.: 10/238,182

(22) Filed: Sep. 10, 2002

(65) Prior Publication Data

US 2003/0084971 A1 May 8, 2003

Related U.S. Application Data

(63) Continuation-in-part of application No. 10/012,908, filed on Oct. 30, 2001, now abandoned.

(51) Int. Cl.[7] ..... C22C 38/58; C21D 9/00
(52) U.S. Cl. ..... 148/325; 148/607; 420/34
(58) Field of Search ..... 420/64, 65, 34; 148/325, 610, 654, 607

(56) References Cited

U.S. PATENT DOCUMENTS

| | | | | |
|---|---|---|---|---|
| 3,650,709 A | | 3/1972 | Morsing | |
| 3,736,131 A | | 5/1973 | Espy | |
| 4,340,432 A | | 7/1982 | Hede | |
| 4,798,635 A | | 1/1989 | Bernhardsson et al. | |
| 4,828,630 A | | 5/1989 | Daniels et al. | |
| 5,047,096 A | * | 9/1991 | Eriksson et al. | 148/325 |
| 5,238,508 A | | 8/1993 | Yoshitake et al. | |
| 5,298,093 A | | 3/1994 | Okamoto | |
| 5,624,504 A | | 4/1997 | Miyakusu et al. | |
| 5,672,215 A | | 9/1997 | Azuma et al. | |
| 6,096,441 A | | 8/2000 | Hauser et al. | |

FOREIGN PATENT DOCUMENTS

| | | |
|---|---|---|
| EP | 0 659 896 B1 | 4/1997 |
| EP | 1 061 151 A1 | 12/2000 |
| JP | 10-102206 | 4/1998 |
| WO | 02/27056 A1 | 4/2002 |

OTHER PUBLICATIONS

J&L Specialty Steel, Inc., Type 2205 (UNS A31803) Duplex Stainless Steel, No Publication Date.

* cited by examiner

*Primary Examiner*—Deborah Yee
(74) *Attorney, Agent, or Firm*—Kirkpatrick & Lockhart LLP

(57) ABSTRACT

A duplex stainless steel includes less than, in weight percent, 3 percent nickel and 1.5 percent molybdenum. In one embodiment, the duplex stainless steel includes, in weight percent, up to 0.06 percent carbon; 15 to 25 percent chromium; 1 to less than 2.5 percent nickel; greater than 2 percent up to 3.75 percent manganese; greater than 0.12 up to 0.35 percent nitrogen; up to 2 percent silicon; up to 1.5 percent molybdenum; up to 0.5 percent copper; up to 0.2 percent cobalt; up to 0.05 percent phosphorous; up to 0.005 percent sulfur; 0.001 to 0.0035 percent boron; iron and incidental impurities. The duplex stainless steel provided may be provided in the form of an article of manufacture, such as strip, bar, plate, sheet, casting, tubing or piping. A method for making the duplex stainless steel of the invention also is disclosed.

45 Claims, No Drawings

DUPLEX STAINLESS STEELS

This application is a continuation-in-part of application Ser. No. 10/012,908 filing date Oct. 30, 2001, now abandoned.

BACKGROUND OF THE INVENTION

1. Field of the Invention

The present invention relates generally to duplex stainless steels. In particular, the present invention relates to duplex stainless steels that can be an economical alternative to certain known duplex stainless steels, while also providing improved corrosion resistance relative to certain austenitic stainless steels, such as the Type 304, 316 and 317 austenitic stainless steels. The present invention is also directed to a method of manufacturing the duplex stainless steels of the invention. The duplex stainless steels of the present invention find application in, for example, corrosive environments and into articles of manufacture, such as, for example, strip, bar, plate, sheet, castings, pipe or tube.

2. Description of the Invention Background

Duplex stainless steels are alloys that contain a microstructure consisting of a mixture of austenite and ferrite phases. Generally, they exhibit certain characteristics of both phases, along with relatively higher strength and ductility. Various duplex stainless steels have been proposed, some of which are described in U.S. Pat. Nos. 3,650,709, 4,340,432, 4,798,635, 4,828,630, 5,238,508, 5,298,093, 5,624,504, and 6,096,441.

Early duplex alloys had moderate resistance to general corrosion and chloride stress corrosion cracking, but suffered a substantial loss of properties when used in the as-welded condition. Presently, one of the most widely used second-generation duplex stainless steels is available under the trademark AL 2205 (UNS S31803 and/or 32205) from Allegheny Ludlum Corporation, Pittsburgh, Pa. This duplex stainless steel is a nominal 22 percent chromium, 5.5 percent nickel, 3 percent molybdenum, and 0.16 percent nitrogen alloy that provides corrosion resistance in many environments that is superior to the Type 304, 316 and 317 austenitic stainless steels (Unless otherwise noted all percentages herein are weight percentages of total alloy weight). AL 2205, which is a nitrogen-enhanced duplex stainless steel that imparts the metallurgical benefits of nitrogen to improve corrosion performance and as-welded properties, also exhibits a yield strength that is more than double that of conventional austenitic stainless steels. This duplex stainless steel is often used in the form of welded pipe or tubular components, as well as a formed and welded sheet product in environments where resistance to general corrosion and chloride stress corrosion cracking ("SCC") is important. The increased strength creates opportunities for reduction in tube wall thickness and resists handling damage.

As just indicated, AL 2205 has been widely accepted by tube and pipe end users, particularly as a low cost replacement to Type 316 stainless steel when SCC is a concern. This is due, in large part, to the fact that AL 2205 is significantly more resistant to crevice corrosion than the Type 316 and Type 317 austenitic stainless steels. This superior resistance to chloride-ion crevice corrosion is illustrated in the table below, which shows the results of ASTM Procedure G48B using a 10 percent ferric chloride solution. The 10 percent ferric chloride solution referred to is by weight for the hexahydrate salt and is equivalent to an approximately 6 percent by weight solution of the anhydrous ferric chloride salt.

Crevice Corrosion Data in 10% Ferric Chloride

| Alloy | Temperature of Onset of Crevice Corrosion |
|---|---|
| Type 316 | 27° F. (−3° C.) |
| Type 317 | 35° F. (2° C.) |
| AL 2205 | 68° F. (20° C.) |

However, the extraordinary corrosion resistance (and other properties) of AL 2205 may be greater than is required in some applications. In certain SCC applications, while AL 2205 would provide an acceptable technical solution, it may not be an economical replacement alloy for Type 304 stainless steel. The higher cost of AL 2205 is due primarily to the amounts of the alloying elements nickel (nominal 5.5%) and molybdenum (nominal 3%).

Thus, it is desirable to provide a weldable, formable duplex stainless steel that has greater corrosion resistance than the Type 304, Type 316 or Type 317 austenitic stainless steels and may have a lower production cost than the commonly used AL 2205 duplex stainless steel.

SUMMARY OF THE INVENTION

The present invention relates to a duplex stainless steel exhibiting corrosion resistance and having reduced amounts of the alloying elements nickel and molybdenum relative to other duplex stainless steels, including AL 2205. According to one embodiment of the present invention, the duplex stainless steel comprises, in weight percent, up to 0.06 percent carbon; 15 percent to less than 19 percent chromium; 1 percent to less than 3 percent nickel; greater than 2 percent up to 3.75 percent manganese; greater than 0.12 percent up to 0.35 percent nitrogen; up to 2 percent silicon; up to 1.5 percent molybdenum; up to 0.5 percent copper; up to 0.2 percent cobalt; up to 0.05 percent phosphorous; up to 0.005 percent sulfur; up to 0.03 percent boron; iron and incidental impurities. According to another embodiment of the present invention, the duplex stainless steel comprises, in weight percent: up to 0.06 percent carbon; 15 percent to 25 percent chromium; 1 percent to less than 2.5 percent nickel; greater than 2 percent up to 3.75 percent manganese; greater than 0.12 percent to 0.35 percent nitrogen; up to 2 percent silicon; up to 1.5 percent molybdenum; up to 0.5 percent copper; up to 0.2 percent cobalt; up to 0.05 percent phosphorous; up to 0.005 percent sulfur; 0.001 percent to 0.0035 percent boron; iron and incidental impurities. According to yet another embodiment of the present invention, the duplex stainless steel comprises, in weight percent, up to 0.06 percent carbon; 15 percent to less than 21.5 percent chromium; 1 percent to less than 3 percent nickel; greater than 2 percent up to 3.75 percent manganese; greater than 0.12 percent up to 0.35 percent nitrogen; up to 2 percent silicon; up to 1.5 percent molybdenum; up to 0.5 percent copper; up to 0.2 percent cobalt; up to 0.05 percent phosphorous; up to 0.005 percent sulfur; 0.001 percent to 0.0035 percent boron; iron and incidental impurities. In yet another embodiment, the duplex stainless steel comprises, in weight percent: up to 0.03 percent carbon; 19 percent up to 21.5 percent chromium; 1 percent up to 2.5 percent nickel; greater than 2 percent up to 3.75 percent manganese; 0.12 percent up to 0.3 percent nitrogen; up to 1 percent silicon; 0.75 percent up to 1.5 percent molybdenum; up to 0.4 percent copper; up to 0.2 percent cobalt; up to 0.03 percent phosphorus; up to 0.02 percent sulfur; 0.001 percent up to 0.0035 percent boron; iron and incidental impurities.

The present invention also relates to articles of manufacture such as, for example, strip, bar, plate, sheet, castings, tubing, or piping fabricated from or including the duplex stainless steels of the present invention. The articles formed of the duplex stainless steels of the present invention may be particularly advantageous when intended for service in chloride containing environments. Furthermore, the present invention relates to methods for making duplex stainless steels. In particular, according to the method of the present invention, a duplex stainless steel having a chemistry as previously described is provided and is subject to processing, including solution annealing and cooling. The steel may be further processed to an article of manufacture or into any other desired form.

DETAILED DESCRIPTION OF THE INVENTION

The present invention relates to duplex stainless steels characterized by including reduced amounts of the alloying elements nickel and molybdenum relative to certain known duplex stainless steels, including AL 2205. In particular, the duplex stainless steel of the present invention contains, in weight percent: less than 3 percent nickel and up to 1.5 percent molybdenum. According to one particular embodiment of the present invention, the duplex stainless steel comprises, in weight percent: up to 0.06 percent carbon; 15 percent to less than 19 percent chromium; 1 percent to less than 3 percent nickel; greater than 2 percent up to 3.75 percent manganese; greater than 0.12 percent up to 0.35 percent nitrogen; up to 2 percent silicon; up to 1.5 percent molybdenum; up to 0.5 percent copper; up to 0.2 percent cobalt, up to 0.05 percent phosphorous; up to 0.005 percent sulfur; up to 0.03 percent boron; iron and incidental impurities. According to another embodiment of the present invention, the duplex stainless steel includes, in weight percent: up to 0.06 percent carbon; 15 percent to 25 percent chromium; 1 percent to less than 2.5 percent nickel; greater than 2 percent up to 3.75 percent manganese; greater than 0.12 percent up to 0.35 percent nitrogen; up to 2 percent silicon; up to 1.5 percent molybdenum; up to 0.5 percent copper; up to 0.2 percent cobalt; up to 0.05 percent phosphorous; up to 0.005 percent sulfur; 0.001 percent to 0.0035 percent boron; iron and incidental impurities. According to yet another embodiment of the present invention, the duplex stainless steel comprises, in weight percent: up to 0.06 percent carbon; 15 percent to less than 21.5 percent chromium; 1 to less than 3 percent nickel; greater than 2 percent up to 3.75 percent manganese; greater than 0.12 percent up to 0.35 percent nitrogen; up to 2 percent silicon; up to 1.5 percent molybdenum; up to 0.5 percent copper; up to 0.2 percent cobalt; up to 0.05 percent phosphorous; up to 0.005 percent sulfur; 0.001 percent to 0.0035 percent boron; iron and incidental impurities. In yet another embodiment, the duplex stainless steel of the present invention comprises, in weight percent: up to 0.03 percent carbon; 19 percent up to 21.5 percent chromium; 1 percent up to 2.5 percent nickel; greater than 2 percent up to 3.75 percent manganese; 0.12 percent up to 0.3 percent nitrogen; up to 1 percent silicon; 0.75 percent up to 1.5 percent molybdenum; up to 0.4 percent copper; up to 0.2 percent cobalt; up to 0.03 percent phosphorus; up to 0.02 percent sulfur; 0.001 percent up to 0.0035 percent boron; iron and incidental impurities. It will be understood that in the steel compositions just recited, carbon, silicon, molybdenum, copper, cobalt, phosphorus, sulfur and, in one embodiment only, boron, are optional components of the steel.

The duplex stainless steels of the present invention preferably include the austenite and ferrite phases, each in the range of between 20 percent and 80 percent by volume in the annealed condition. Therefore, as is known in the art, the contents of austenite producing nickel and ferrite producing chromium must be balanced to ensure proper austenite/ferrite phase balance and consistent properties.

Embodiments of the duplex stainless steels are weldable, formable materials that may exhibit greater corrosion resistance than the Type 304, 316 and 317 austenitic stainless steels. In addition to the above elemental ranges, the duplex stainless steels of the present invention may include various other alloying elements and additives as are known in the art. Embodiments of the duplex stainless steels of the invention may be less costly to produce than the commonly used AL 2205 alloy and certain other duplex stainless steels, because of a lower content of alloying elements, particularly nickel and molybdenum. Nevertheless, an enhanced level of corrosion resistance over the Type 304, 316 and 317 austenitic stainless steels is expected from the duplex stainless steels of the present invention. Moreover, the duplex stainless steels of the present invention provide a stable austenite phase (with respect to deformation induced martensite) and the desired level of corrosion resistance. Below, the nickel and molybdenum content of certain embodiments of the present invention are compared to AL 2205.

Amounts of Alloying Elements Ni and Mo (In Weight Percent)

| Alloying Element | AL 2205 | Present Invention |
|---|---|---|
| Ni | 5.5% nominal | 1% - less than 3% |
| Mo | 3% nominal | up to 1.5% |

Despite an expected lower cost of production as compared to the current cost of AL 2205, it is expected that the duplex stainless steels of the present invention will exhibit pitting/crevice corrosion resistance that is significantly greater than the Type 304, 316 and 317 austenitic stainless steels. It is expected, however, that the steels of the present invention will have reduced corrosion resistance, but greater stretch formability than AL 2205 due to the lower content of nickel and molybdenum in the steels of the present invention. Thus, the duplex stainless steel of the present invention may be particularly advantageous as a lower cost alternative to AL 2205 in less demanding applications in which AL 2205 is now used.

According to various embodiment of the present invention, the duplex stainless steel may comprise, in weight percent, up to 0.03 percent carbon, at least 17 percent chromium, at least 1.5 percent nickel, greater than 2 up to 3.75 percent manganese, up to 1 percent silicon, 1 to 1.5 molybdenum, and/or 0.001 to 0.0035 percent boron. Thus, depending on the particular embodiment of the present invention employed as a result of the corrosion resistance requirements of the particular application, the duplex stainless steel of the present invention may be less costly to produce than AL 2205 and other duplex stainless steels.

Four 50 lb. heats of duplex stainless steel were prepared as shown in Table 1, with elemental concentrations shown in weight percentages. The ingots were conditioned, re-heated and hot rolled to approximately ¼ inch thick. The material was then annealed, pickled, and cold rolled to approximately 0.070 inch thick strips. These strips were then annealed and pickled, and suitable test specimens were prepared.

TABLE 1

| Element | Heat 1 | Heat 2 | Heat 3 | Heat 4 |
|---|---|---|---|---|
| C | 0.042 | 0.062 | 0.049 | 0.035 |
| Mn | 2.41 | 2.67 | 2.84 | 2.86 |
| Si | 0.22 | 0.38 | 0.64 | 0.68 |
| Cr | 19.77 | 20.29 | 21.18 | 19.2 |
| Ni | 1.27 | 1.51 | 1.75 | 2.49 |
| Mo | 1.05 | 1.31 | 1.52 | 1.18 |
| Cu | 0.19 | 0.18 | 0.18 | 0.2 |
| N | 0.19 | 0.2 | 0.2 | 0.177 |
| P | 0.024 | 0.024 | 0.024 | 0.027 |
| S | 0.004 | 0.004 | 0.004 | 0.004 |
| Co | 0.01 | 0.01 | 0.01 | 0.01 |
| B | 0.001 | 0.001 | 0.0012 | 0.0028 |

The test specimens were evaluated for ferrite and martensite contents, mechanical properties, and corrosion resistance, with the results shown in Table 2. The percent ferrite reported in Table 2 was measured by the point count method described by ASTM Standard E-562. The percent martensite reported in Table 2 was measured using a Fischer Feritscope. Feritscope measurements were taken before and after the material was cold rolled to a 70 percent reduction. The difference in the readings was taken to be the percent martensite that formed during cold rolling. Rockwell hardness was measured and tensile tests were performed on annealed samples according to ASTM Standard E8. SCC tests were performed on U-bend samples in boiling 33 percent LiCl and 26 percent NaCl exposed for 1000 hours or until the samples cracked. The critical pitting corrosion temperature ("CPT") was obtained electrochemically, according to ASTM Standard G150.

TABLE 2

| Property | Heat 1 | Heat 2 | Heat 3 | Heat 4 |
|---|---|---|---|---|
| Percent Ferrite | 41.4 | 41.8 | 47.0 | 24.8 |
| Percent Martensite after Cold Rolling | 16.2 | 4.1 | 0 | 12.4 |
| Rockwell B Hardness | 94.4 | 95.4 | 96.0 | 95.9 |
| Longitudinal Yield Strength (ksi) | 70.2 | 74.1 | 76.0 | 72.5 |
| Longitudinal Tensile Strength (ksi) | 126.1 | 112.9 | 110.1 | 120.6 |
| Longitudinal Elongation (%) | 39.8 | 41.5 | 32.0 | 44.7 |
| Transverse Yield Strength (ksi) | 69.6 | 73.2 | 75.0 | 74.7 |
| Transverse Tensile Strength (ksi) | 120.0 | 109.5 | 108.0 | 116.5 |
| Transverse Elongation (%) | 38.5 | 39.5 | 31.0 | 43.5 |
| SCC in NaCl (hrs) | 1000+* | 1000+* | 1000+* | 1000+* |
| SCC in LiCl (hrs) | 170 | 165 | 30 | 180 |
| CPT (° F.) | 68.1 | 81.1 | 93.3 | 78.7 |

*Test sample did not crack

As illustrated in Table 3 below, the CPT of Heats 1–4 above were quite high in comparison to type 316 austenitic stainless steels and even compared favorably to the 2304 and 19D duplex stainless steels.

TABLE 3

| Alloy | CPT (° C.) |
|---|---|
| 2205 (UNS S31803) | 49.0 |
| 317 LX (UNS S31725) | 42.4 |
| Heat 3 of Table 1 | 34.1 |
| 317 L (UNS S31703) | 33.5 |
| Heat 2 of Table 1 | 27.3 |
| Heat 4 of Table 1 | 25.9 |
| 2304 (UNS S32304) | 23.2 |
| Heat 1 of Table 1 | 20.1 |
| 316 (UNS S31600) | 17.3 |
| 19D (UNS S32001) | 10.2 |

As is evident, the duplex stainless steel of the present invention exhibited comparable corrosion resistance to austenitic stainless steels and other duplex stainless steels while maintaining lower nickel and molybdenum contents, which reduces the cost of the alloy. As is also apparent, the corrosion resistance properties of the duplex stainless steel of the present invention were particularly favorable when the manganese content was maintained within a preferred range of 2.5 to 3.0 weight percent.

The present invention also relates to articles of manufacture such as, for example, strip, bar, plate, sheet, castings, tubing, and piping composed of or including the duplex stainless steels of the present invention. According to one embodiment of the present invention, the article of manufacture is composed of or includes a duplex stainless steel comprising, in weight percent: up to 0.06 percent carbon; 15 percent to less than 19 percent chromium; 1 percent to less than 3 percent nickel; greater than 2 percent up to 3.75 percent manganese; greater than 0.12 percent up to 0.35 percent nitrogen; up to 2 percent silicon; up to 1.5 percent molybdenum; up to 0.5 percent copper; up to 0.2 percent cobalt; up to 0.05 percent phosphorous; up to 0.005 percent sulfur; up to 0.03 percent boron; iron and incidental impurities. According to another embodiment of the present invention, the article of manufacture is composed of or includes a duplex stainless steel comprising, in weight percent: up to 0.06 percent carbon; 15 percent to 25 percent chromium; 1 percent to less than 2.5 percent nickel; greater than 2 percent up to 3.75 percent manganese; greater than 0.12 percent up to 0.35 percent nitrogen; up to 2 percent silicon; up to 1.5 percent molybdenum; up to 0.5 percent copper; up to 0.2 percent cobalt; up to 0.05 percent phosphorous; up to 0.005 percent sulfur; 0.001 percent to 0.0035 percent boron; iron and incidental impurities. According to yet another embodiment of the present invention, the article of manufacture is composed of or includes a duplex stainless steel comprising, in weight percent: up to 0.06 percent carbon; 15 percent to less than 21.5 percent chromium; 1 percent to less than 3 percent nickel; greater than 2 percent up to 3.75 percent manganese; greater than 0.12 percent up to 0.35 percent nitrogen; up to 2 percent silicon; up to 1.5 percent molybdenum; up to 0.5 percent copper; up to 0.2 percent cobalt; up to 0.05 percent phosphorous; up to 0.005 percent sulfur; 0.001 percent to 0.0035 percent boron; iron and incidental impurities. In yet another embodiment of the invention, the article of manufacture is composed of or includes a duplex stainless steel that comprises, in weight percent: up to 0.03 percent carbon; 19 percent up to 21.5 percent chromium; 1 percent up to 2.5 percent nickel; greater than 2 percent up to 3.75 percent manganese; 0.12 percent up to 0.3 percent nitrogen; up to 1 percent silicon; 0.75 percent up to 1.5 percent molybdenum; up to 0.4 percent copper; up to 0.2 percent cobalt; up to 0.03 percent phosphorus; up to 0.02 percent sulfur; 0.001 percent up to 0.0035 percent boron; iron and incidental impurities.

In addition, the present invention relates to a method for making a duplex stainless steel including, in weight percent: less than 3 percent nickel and up to 1.5 percent molybdenum. According to one embodiment of the method of the present invention, a duplex stainless steel is provided comprising, in weight percent: up to 0.06 percent carbon; 15 percent to less than 19 percent chromium; 1 percent to less than 3 percent nickel; greater than 2 percent up to 3.75 percent manganese; greater than 0.12 percent up to 0.35 percent nitrogen; up to 2 percent silicon; up to 1.5 percent molybdenum; up to 0.5 percent copper; up to 0.2 percent cobalt; up to 0.05 percent phosphorous; up to 0.005 percent sulfur; up to 0.03 percent boron; iron and incidental impurities, is provided. The duplex stainless steel is subsequently solution annealed and then cooled.

According to another embodiment of the method of the present invention, a duplex stainless steel is provided comprising, in weight percent: up to 0.06 percent carbon; 15 percent to 25 percent chromium; 1 percent to less than 2.5 percent nickel; greater than 2 percent up to 3.75 percent manganese; greater than 0.12 percent up to 0.35 percent nitrogen; up to 2 percent silicon; up to 1.5 percent molybdenum; up to 0.5 percent copper; up to 0.2 percent cobalt; up to 0.05 percent phosphorous; up to 0.005 percent sulfur; 0.001 percent to 0.0035 percent boron; iron and incidental impurities is provided. The duplex stainless steel is subsequently solution annealed and cooled.

According to yet another embodiment of the method of the present invention, a duplex stainless steel is provided comprising, in weight percent: up to 0.06 percent carbon; 15 percent to less than 21.5 percent chromium; 1 percent to less than 3 percent nickel; greater than 2 percent up to 3.75 percent manganese; greater than 0.12 percent up to 0.35 percent nitrogen; up to 2 percent silicon; up to 1.5 percent molybdenum; up to 0.5 percent copper; up to 0.2 percent cobalt; up to 0.05 percent phosphorous; up to 0.005 percent sulfur; 0.001 percent to 0.0035 percent boron; iron and incidental impurities. The steel is subsequently solution annealed, and cooled.

In yet another embodiment of the method of the present invention, a duplex stainless steel is provided comprising, in weight percent: up to 0.03 percent carbon; 19 percent up to 21.5 percent chromium; 1 percent up to 2.5 percent nickel; greater than 2 percent up to 3.75 percent manganese; 0.12 percent up to 0.3 percent nitrogen; up to 1 percent silicon; 0.75 percent up to 1.5 percent molybdenum; up to 0.4 percent copper; up to 0.2 percent cobalt; up to 0.03 percent phosphorus; up to 0.02 percent sulfur; 0.001 percent up to 0.0035 percent boron; iron and incidental impurities. The steel is subsequently solution annealed, and cooled.

In any of the above methods, other processing techniques and steps known to those in the art may be used. For example, the steels may be further processed using known techniques to provide an article of manufacture, such as those mentioned above, or into any other desired form.

It is to be understood that the present description illustrates aspects of the invention relevant to a clear understanding of the invention. Certain aspects of the invention that would be apparent to those of ordinary skill in the art and that, therefore, would not facilitate a better understanding of the invention have not been presented in order to simplify the present description. Although the present invention has been described in connection with only certain embodiments, those of ordinary skill in the art will, upon considering the foregoing description, recognize that many embodiments, modifications, and variations of the invention may be made. The foregoing description and the following claims cover all such variations and modifications of the invention.

We claim:

1. A duplex stainless steel comprising, in weight percent: up to 0.06 percent carbon; 15 to less than 19 percent chromium; 1 to less than 2 percent nickel; greater than 2 percent up to 3.75 percent manganese; greater than 0.12 up to 0.35 percent nitrogen; up to 2 percent silicon; up to 1.5 percent molybdenum; up to 0.5 percent copper; up to 0.2 percent cobalt; up to 0.05 percent phosphorous; up to 0.005 percent sulfur; up to 0.03 percent boron; iron and incidental impurities.

2. The duplex stainless steel of claim 1 comprising up to 0.03 percent carbon.

3. The duplex stainless steel of claim 1 comprising 17 to less than 19 percent chromium.

4. The duplex stainless steel of claim 1 comprising 1 to 1.75 percent nickel.

5. The duplex stainless steel of claim 1 comprising 2.5 to 3.0 percent manganese.

6. The duplex stainless steel of claim 1 comprising greater than 0.12 up to 0.20 percent nitrogen.

7. The duplex stainless steel of claim 1 comprising up to 1 percent silicon.

8. The duplex stainless steel of claim 1 comprising 1 to 1.5 percent molybdenum.

9. The duplex stainless steel of claim 1 comprising 0.001 to 0.0035 percent boron.

10. A duplex stainless steel comprising, in weight percent: up to 0.03 percent carbon; 17 to less than 19 percent chromium; 1 to 1.75 percent nickel; 2.5 percent up to 3.0 percent manganese; greater than 0.12 up to 0.20 percent nitrogen; up to 1 percent silicon; 1 up to 1.5 percent molybdenum; up to 0.5 percent copper; up to 0.2 percent cobalt; up to 0.05 percent phosphorous; up to 0.005 percent sulfur; up to 0.03 percent boron; iron and incidental impurities.

11. An article of manufacture including a duplex stainless steel comprising, in weight percent: up to 0.06 percent carbon; 15 to less than 19 percent chromium; 1 to less than 2 percent nickel; greater than 2 percent up to 3.75 percent manganese; greater than 0.12 up to 0.35 percent nitrogen; up to 2 percent silicon; up to 1.5 percent molybdenum; up to 0.5 percent copper; up to 0.2 percent cobalt; up to 0.05 percent phosphorous; up to 0.005 percent sulfur; up to 0.03 percent boron; iron and incidental impurities.

12. The article of claim 11 wherein the article is selected from the group consisting of strip, bar, plate, sheet, casting, tubing and piping.

13. A method for making a duplex stainless steel, the process comprising:

providing a duplex stainless steel comprising, in weight percent, up to 0.06 percent carbon, 15 to less than 19 percent chromium, 1 to less than 2 percent nickel, greater than 2 percent up to 3.75 percent manganese, greater than 0.12 up to 0.35 percent nitrogen, up to 2 percent silicon, up to 1.5 percent molybdenum, up to 0.5 percent copper, up to 0.2 percent cobalt, up to 0.05 percent phosphorous, up to 0.005 percent sulfur, up to 0.03 percent boron, iron and incidental impurities;

solution annealing the steel; and cooling the steel.

14. A duplex stainless steel comprising, in weight percent: up to 0.06 percent carbon; 15 to 25 percent chromium; 1 to less than 2 percent nickel; greater than 2 percent up to less than 3 percent manganese; greater than 0.12 up to 0.35 percent nitrogen; up to 2 percent silicon; up to 1.5 percent molybdenum; up to 0.5 percent copper; up to 0.2 percent cobalt; up to 0.05 percent phosphorous; up to 0.005 percent sulfur; 0.001 to 0.0035 percent boron; iron and incidental impurities.

15. The duplex stainless steel of claim 14 comprising up to 0.03 percent carbon.

16. The duplex stainless steel of claim 14 comprising 17 to 20 percent chromium.

17. The duplex stainless steel of claim 14 comprising 1 to 1.75 percent nickel.

18. The duplex stainless steel of claim 14 comprising 2.5 up to less than 3.0 percent manganese.

19. The duplex stainless steel of claim 14 comprising greater than 0.12 up to 0.20 percent nitrogen.

20. The duplex stainless steel of claim 14 comprising up to 1 percent silicon.

21. The duplex stainless steel of claim 14 comprising 1 to 1.5 percent molybdenum.

22. A duplex stainless steel comprising, in weight percent: up to 0.03 percent carbon; 17 to 20 percent chromium; 1 to less-then 1.75 percent nickel; greater than 2 percent up to less than 3 percent manganese; greater than 0.12 up to 0.20 percent nitrogen; up to 1 percent silicon; 1 to 1.5 percent molybdenum; less than 0.5 percent copper; less than 0.2 percent cobalt; up to 0.05 percent phosphorous; up to 0.005 percent sulfur; 0.001 up to 0.0035 percent boron; iron and incidental impurities.

23. An article of manufacture including a duplex stainless steel comprising, in weight percent: up to 0.06 percent carbon; 15 to 25 percent chromium; 1 to less than 2 percent nickel; greater than 2 percent up to less than 3 percent manganese; greater than 0.12 up to 0.35 percent nitrogen; up to 2 percent silicon; up to 1.5 percent molybdenum; up to 0.5 percent copper; up to 0.2 percent cobalt; up to 0.05 percent phosphorous; up to 0.005 percent sulfur; 0.001 to 0.0035 percent boron, iron and incidental impurities.

24. The article of claim 23 wherein said article is selected from the group consisting of strip, bar, plate, sheet, casting, tubing and piping.

25. A method for making a duplex stainless steel, the method comprising:

providing a duplex stainless steel comprising, in weight percent, up to 0.06 percent carbon, 15 to 25 percent chromium, 1 to less than 2 percent nickel, greater than 2 percent up to less than 3 percent manganese, greater than 0.12 up to 0.35 percent nitrogen, up to 2 percent silicon, up to 1.5 percent molybdenum, up to 0.5 percent copper, up to 0.2 percent cobalt, up to 0.05 percent phosphorous, up to 0.005 percent sulfur, 0.001 to 0.0035 percent boron, iron and incidental impurities;

solution annealing the steel; and cooling the steel.

26. A duplex stainless steel comprising, in weight percent: up to 0.06 percent carbon; 15 to less than 21.5 percent chromium; 1 to less than 2 percent nickel; greater than 2 percent up to less than 3 percent manganese; greater than 0.12 up to 0.35 percent nitrogen; up to 2 percent silicon; up to 1.5 percent molybdenum; up to 0.5 percent copper; up to 0.2 percent cobalt; up to 0.05 percent phosphorous; up to 0.005 percent sulfur; 0.001 to 0.0035 percent boron; iron and incidental impurities.

27. The duplex stainless steel of claim 26 comprising up to 0.03 percent carbon.

28. The duplex stainless steel of claim 26 comprising 17 to 20 percent chromium.

29. The duplex stainless steel of claim 26 comprising 1 to 1.75 percent nickel.

30. The duplex stainless steel of claim 26 comprising 2.5 to less than 3.0 percent manganese.

31. The duplex stainless steel of claim 26 comprising greater than 0.12 up to 0.20 percent nitrogen.

32. The duplex stainless steel of claim 26 comprising up to 1 percent silicon.

33. The duplex stainless steel of claim 26 comprising 1 to 1.5 percent molybdenum.

34. A duplex stainless steel comprising, in weight percent: up to 0.03 percent carbon; 17 to 20 percent chromium; 1 to 1.75 percent nickel; greater than 2 percent up to less than 3 percent manganese; greater than 0.12 up to 0.20 percent nitrogen; up to 1 percent silicon; 1 to 1.5 percent molybdenum; up to 0.5 percent copper; up to 0.2 percent cobalt; up to 0.05 percent phosphorous; up to 0.005 percent sulfur; 0.001 up to 0.0035 percent boron; iron and incidental impurities.

35. An article of manufacture including a duplex stainless steel comprising, in weight percent: up to 0.06 percent carbon; 15 to 21.5 percent chromium; 1 to less than 2 percent nickel; greater than 2 percent up to less than 3 percent manganese; greater than 0.12 up to 0.35 percent nitrogen; up to 2 percent silicon; up to 1.5 percent molybdenum; up to 0.5 percent copper; up to 0.2 percent cobalt; up to 0.05 percent phosphorous; up to 0.005 percent sulfur; 0.001 to 0.0035 percent boron; iron and incidental impurities.

36. The article of claim 35 wherein said article is selected from the group consisting of strip, bar, plate, sheet, casting, tubing and piping.

37. A method for making a duplex stainless steel, the method comprising:

providing a duplex stainless steel comprising, in weight percent, up to 0.06 percent carbon, 15 to 21.5 percent chromium, 1 to less than 2 percent nickel, greater than 2 percent up to less than 3 percent manganese, greater than 0.12 up to 0.35 percent nitrogen, up to 2 percent silicon, up to 1.5 percent molybdenum, up to 0.5 percent copper, up to 0.2 percent cobalt, up to 0.05 percent phosphorous, up to 0.005 percent sulfur, 0.001 to 0.0035 percent boron, iron and incidental impurities;

solution annealing the steel; and cooling the steel.

38. A duplex stainless steel comprising, in weight percent: up to 0.03 percent carbon; 19 percent up to 21.5 percent chromium; 1 percent up to less than 2 percent nickel; greater than 2.0 percent up to less than 3 percent manganese; 0.12 percent up to 0.3 percent nitrogen; up to 1 percent silicon; 0.75 percent up to 1.5 percent molybdenum; up to 0.4 percent copper; up to 0.2 percent cobalt; up to 0.03 percent phosphorus; up to 0.02 percent sulfur; 0.001 percent up to 0.0035 percent boron; iron and incidental impurities.

39. An article of manufacture including a duplex stainless steel comprising, in weight percent: up to 0.03 percent carbon; 19 percent up to 21.5 percent chromium; 1 percent up to less than 2 percent nickel; greater than 2.0 percent up to less than 3 percent manganese; 0.12 percent up to 0.3 percent nitrogen; up to 1 percent silicon; 0.75 percent up to 1.5 percent molybdenum; up to 0.4 percent copper; up to 0.2 percent cobalt; up to 0.03 percent phosphorus; up to 0.02 percent sulfur; 0.001 percent up to 0.0035 percent boron; iron and incidental impurities.

40. The article of manufacture of claim 39 wherein said article is selected from the group consisting of strip, bar, plate, sheet, casting, tubing and piping.

41. A method for making a duplex stainless steel, the method comprising:

providing a duplex stainless steel comprising, in weight percent, up to 0.03 percent carbon, 19 percent up to 21.5 percent chromium, 1 percent up to less than 2 percent nickel, greater than 2 percent up to less than 3 percent manganese, 0.12 percent up to 0.3 percent nitrogen, up to 1 percent silicon, 0.75 percent up to 1.5 percent molybdenum, up to 0.4 percent copper, up to 0.2 percent cobalt, up to 0.03 percent phosphorus, up to 0.02 percent sulfur, 0.001 percent up to 0.0035 percent boron, iron and incidental impurities, solution annealing the steel; and cooling the steel.

42. A duplex stainless steel comprising, in weight percent: up to 0.06 percent carbon; 15 up to 25 percent chromium; 1 percent up to less than 2 percent nickel; greater than 2 percent up to 3.75 percent manganese; 0.12 up to 0.35 percent nitrogen; up to 2 percent silicon; greater than 1 percent up to 1.5 percent molybdenum; up to 0.5 percent copper; up to 0.2 percent cobalt; up to 0.05 percent phosphorous; up to 0.005 percent sulfur; 0.001 to 0.0035 percent boron; iron and incidental impurities.

43. An article of manufacture including a duplex stainless steel comprising, in weight percent: up to 0.06 percent carbon; 15 percent up to 25 percent chromium; 1 percent up to less than 2 percent nickel; greater than 2 percent up to 3.75 percent manganese; 0.12 percent up to 0.35 percent nitrogen; up to 2 percent silicon; greater than 1 percent up to 1.5 percent molybdenum; up to 0.5 percent copper; up to 0.2 percent cobalt; up to 0.05 percent phosphorous; up to 0.005 percent sulfur; 0.001 to 0.0035 percent boron; iron and incidental impurities.

44. The article of manufacture of claim 43 wherein said article is selected from the group consisting of strip, bar, plate, sheet, casting, tubing and piping.

45. A method for making a duplex stainless steel, the method comprising:

providing a duplex stainless steel comprising, in weight percent, up to 0.06 percent carbon, 15 percent up to 25 percent chromium, 1 percent up to less than 2 percent nickel, greater than 2 percent up to 3.75 percent manganese, 0.12 percent up to 0.35 percent nitrogen, up to 2 percent silicon, greater than 1 percent up to 1.5 percent molybdenum, up to 0.5 percent copper, up to 0.2 percent cobalt, up to 0.05 percent phosphorous, up to 0.005 percent sulfur, 0.001 to 0.0035 percent boron, iron and incidental impurities;

solution annealing the steel; and cooling the steel.

* * * * *